US007694957B2

(12) United States Patent
Nukada et al.

(10) Patent No.: US 7,694,957 B2
(45) Date of Patent: Apr. 13, 2010

(54) SEPARATION AND EXTRACTION DEVICE

(75) Inventors: Hideki Nukada, Yokohama (JP); Yuko Kobayashi, Kawasaki (JP); Kiminori Toya, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 382 days.

(21) Appl. No.: 11/535,733

(22) Filed: Sep. 27, 2006

(65) Prior Publication Data

US 2007/0205551 A1 Sep. 6, 2007

(30) Foreign Application Priority Data

Mar. 6, 2006 (JP) ..... 2006-059608

(51) Int. Cl.
*B65H 3/60* (2006.01)

(52) U.S. Cl. ..... 271/146

(58) Field of Classification Search ..... 271/146, 271/94, 145

See application file for complete search history.

(56) References Cited

U.S. PATENT DOCUMENTS

| | | | | |
|---|---|---|---|---|
| 3,545,741 | A * | 12/1970 | Porth | 270/58.1 |
| 3,847,382 | A * | 11/1974 | McKee | 271/4.08 |
| 3,976,291 | A * | 8/1976 | Bernardi et al. | 271/94 |
| 4,955,598 | A * | 9/1990 | Hiroshige et al. | 271/267 |
| 5,934,662 | A * | 8/1999 | Acquaviva | 271/18.1 |
| 5,967,507 | A * | 10/1999 | Moore et al. | 271/94 |
| 2007/0273080 | A1 * | 11/2007 | Toya et al. | 271/109 |

FOREIGN PATENT DOCUMENTS

| | | | |
|---|---|---|---|
| DE | 199 43 029 | A1 | 4/2000 |
| EP | 0 905 067 | A1 | 3/1999 |
| EP | 0 978 466 | A2 | 2/2000 |
| JP | 62-17653 | | 2/1987 |
| JP | 6-48602 | | 2/1994 |
| JP | 6-329287 | | 11/1994 |
| JP | 7-69466 | | 3/1995 |
| JP | 11-106075 | | 4/1999 |
| JP | 2002-356240 | | 12/2002 |
| JP | 2003-290811 | | 10/2003 |
| JP | 2004-2044 | | 1/2004 |

* cited by examiner

*Primary Examiner*—Kaitlin S Joerger
(74) *Attorney, Agent, or Firm*—Oblon, Spivak, McClelland, Maier & Neustadt, L.L.P.

(57) ABSTRACT

In a device that separates a sheet and extracts the sheet from a stack of the sheets, the stack of sheets is placed on a sheet feeding unit. A vibrator is in contact with the top surface of the stack at a spot to vibrate the sheets at a high frequency. The high-frequency vibration reduces the adhesion and frictional force among the sheets. A sheet extraction mechanism conveys each sheet.

15 Claims, 11 Drawing Sheets

SEPARATION AND EXTRACTION DEVICE

CROSS-REFERENCE TO RELATED APPLICATIONS

This application is based upon and claims the benefit of priority from prior Japanese Patent Application No. 2006-059608, filed Mar. 6, 2006, the entire contents of which are incorporated herein by reference.

BACKGROUND OF THE INVENTION

1. Field of the Invention

The present invention relates to a separation and extraction device for sheets which separates a sheet in a sheet stack and extract the sheet from the sheet stack, and in particular, to a separation and extraction device which vibrates and loosens a sheet stack to separate a sheet in a sheet stack and extract a sheet from the sheet stack.

2. Description of the Related Art

Coping machines, printers, automatic teller machines (ATMs) in banknote processing applications, mail processing apparatuses, and the like handle sheets (paper-like media) such as print sheets, bills, copy paper, postcards, envelopes, and certificates. These machines need to extract a sheet from a stack of plural sheets. The machines thus comprise a separation and extraction device for sheets (paper-like media). By way of example, a bill processing unit of an automatic teller machine repeats extracting a bill from a bundle of bills (stack of sheets) stacked in a money input and output unit or a storage safe box. The bill processing unit then inspects the extracted bill. Accordingly, the automatic teller machine comprises a separation and extraction device that always separates a bill from a bundle of bills.

For conventional separation and extraction devices that separate a sheet and extract the sheet (paper-like media) from a sheet stack, it is most important to precisely extract each sheet into the apparatus while preventing overlapping sheets from being introduced at a time. Stacked sheets (paper-like media) are in close contact with one another for a long time and thus often stick to one another. Thus, each sheet needs to be separated and extracted, reliably.

The separation and extraction devices are roughly classified into frictional type that apply a frictional force on a sheet stack to separate sheets from one another and vacuum suction type that apply both a vacuum suction force and a frictional force on a sheet stack to separate sheets from one another. The vacuum suction type extraction devices generally exhibit good extraction performance but disadvantageously require a large size and high costs and make much noise. The frictional type separation and extraction devices advantageously eliminate the need for a large size and high costs and avoid making much noise. However, an extraction mechanism such as a conveying roller or a belt depends on the frictional force of media and may cause an error during a separation and extraction operation.

To separate adhering sheets from one another, the conventional separation and extraction device exerts a strong extraction force on an extraction surface of a bundle of stacked sheets (paper-like media). The conventional separation and extraction device then peels off and brings out a predetermined number of sheets from the stack bundle. After the extraction, the extracted overlapping sheets are separated from one another by an overlap preventing mechanism or the like and conveyed into a sheet processing apparatus.

The overlap preventing mechanism is based on any of various schemes. A common scheme separates sheets from one another by passing overlapping sheets (paper-like media) through a narrow gap. For example, the following scheme is commonly adopted for ATMs, printers, and the like. A wide conveying and separating rollers rotating in opposite directions are arranged parallel to each other via a given gap. If overlapping sheets (paper-like media) are supplied to between these rollers, opposite forces are exerted on the sheets (paper-like media) to separate them from one another. With this scheme, a separating capability is improved by making the size of the given gap closer to the thickness of a single sheet (paper-like media). However, normally, the mere adjustment of the given gap is often insufficient. A bundle of firmly adhering sheets (paper-like media) may block and lock the gap as it is, thus shutting down the apparatus. Such modification occurs frequently.

More specifically, in ordinary frictional separation and extraction devices, stacked sheets are supplied from the bottom of the device along a sheet feeding board. The top surface of the stack is in contact with a feed roller of a feed mechanism. Rotation of the feed roller conveys the uppermost sheet of the stack to a device inlet port comprising an overlap preventing device. The overlap preventing device is composed of a pair of a forward rotating roller and a backward rotating roller arranged parallel to each other via a given gap. The gap is set at a value smaller than that of the thickness of two sheets. When overlapping sheets are passing through these rollers, the lower backward rotating roller returns all these sheets other than the uppermost one toward the bundle of sheets to prevent them from being brought into the apparatus. This prevents overlapping sheets from being brought into the apparatus as they are.

Ordinary vacuum suction type extraction devices use an extraction portion comprising a vacuum suction mechanism that sucks sheets. More specifically, the vacuum suction type extraction device uses a pump or compressor to draw the interior of a drum to a vacuum (negative pressure). The uppermost media of the stack is sucked into a hole formed in the periphery of the drum. The sheet is thus brought out. Specifically, stacked sheet media are fed from the bottom of the device along the sheet feeding board. The top surface of the stack is brought into contact with the vacuum suction feed roller, which then sucks and brings out the top sheet. The vacuum suction type extraction device utilizes the friction roller to exert a stronger extraction force than the frictional separation and extraction device. The vacuum suction type extraction device is thus suitable for fast processing apparatuses that can bring in sheets at high speed.

However, even with the vacuum suction type extraction device, the stacked paper-like media often stick to one another after a long, close contact. Even if a strong extraction force is exerted on the extraction surface in order to separate the paper-like media from one another, overlapping sheets are often brought into the apparatus. The vacuum suction type extraction device thus employs a method of, after a predetermined number of paper-like media are peeled off from the stack bundle, using an overlap preventing mechanism or the like to separate the overlapping sheets from one another and conveying one of the resulting sheets into the apparatus.

Like the frictional type separation and extraction device, the vacuum suction type extraction device adopts a scheme of passing overlapping paper-like media through a narrow gap. As is the case with the overlap preventing mechanism of the frictional type separation and extraction device, the separating capability is improved by making the size of the gap closer to the thickness of single paper-like media. However, the mere adjustment of the gap is often insufficient. A bundle of firmly adhering paper-like media may block and lock the gap as it is, thus shutting down the apparatus. Such modification occurs frequently.

Another overlap preventing mechanism is known which replaces the forward rotating roller and backward rotating roller arranged with the given gap between them. In this mechanism, a feature such as a spring is used to press the backward rotating roller against the surface of a sheet to exert a pressing force on it. This mechanism is effective in preventing the overlapping of sheets (paper-like media) from a bundle of sheets of different thicknesses.

As described above, this overlap preventing mechanism is readily locked if a bundle of firmly adhering sheets is brought into the overlap preventing mechanism. For example, when stacked and pressed, sheets such as picture postcards which have smooth surfaces and which are slightly adhesive adhere considerably firmly to one another. Consequently, when brought out from the feed roller, a bundle of such sheets is stuck between the forward rotating roller and the backward rotating roller. Even when sheared, these paper-like media are not separated from one another. This may lock the device.

Jpn. Pat. Appln. KOKAI Publication No. 2004-002044 is known as an improved technique. The background art in Jpn. Pat. Appln. KOKAI Publication No. 2004-002044 abuts a bar-like vibrating member located above media that is about to be brought out, against the front surface of the media across the width to vibrate the media. This reduces the adhesion among the sheets (paper-like media) to aid an overlap preventing mechanism. This scheme reduces the adhesion among the bundled sheets (paper-like media) before extracting one of the sheets (paper-like media). This avoids extraction overlapping paper-like media. In this overlap preventing mechanism, a bar-like high-frequency vibrating member with a length greater than the width of the sheets (paper-like media) is placed upstream of the feed roller to vibrate the paper-like media, while extracting one of them.

The friction reducing mechanism employed in the overlap preventing mechanism disclosed in Jpn. Pat. Appln. KOKAI Publication No. 2004-002044 is not sufficiently effective when simply vibrating the paper-like media at a low frequency. The vibration frequency needs to be at least several kHz. The inventors' experiments show that in a vibration range from 5 to 10 kHz, the vibrating member makes a very loud noise, which affects the environment in which the device is used. Accordingly, the vibration frequency needs to be at least 10 kHz. However, a very high power of at least several hundred watts needs to be consumed to vibrate the entire vibrating member at a high frequency of at least 10 kHz, the vibrating member having a length greater than the width of the sheets. The power source required to drive such a large high-frequency vibrating member is very expensive. This is a major design problem.

The inventors' experiments also show that the appropriate adhesion between the vibrating member and the sheets is very important to vibration of the stack. A stack of, for example, envelopes or used bills does not always have a flat surface. However, the vibrating member disclosed in Jpn. Pat. Appln. KOKAI Publication No. 2004-002044 is shaped like a plate. It is thus difficult to allow the vibrating member to adhere to the sheets all over the width. The vibrating member can pinpoint a contact position on the sheets but the vibration of the entire bar is only partly used. Consequently, vibration efficiency is very low. It is also possible to use more of the whole pressing force in order to allow the vibrating member to adhere to the sheets all over the width. However, this method presses the stack bundle hard from above, thus disadvantageously increasing the adhesion between the sheets. This produces the opposite effect.

As described above, the conventional separation and extraction devices do not produce the vibrating effect required to reduce the adhesion among the stacked media. Experiments also show that a smaller vibration area is more effective in vibrating the media at high frequency. It has also been found that the shapes and arrangements of the conventional vibrating members present problems.

For the background art disclosed in Jpn. Pat. Appln. KOKAI Publication No. 2004-002044, it is important to prevent overlapping sheets from being brought out from the stack. The sheets are thus vibrated in order to improve the overlap prevention. However, the shape of the vibrating member is not optimum, resulting in reduced vibration efficiency. The power source required to drive the vibrating member is also large and expensive. As a result, this background art is not practicable.

BRIEF SUMMARY OF THE INVENTION

According to an aspect of the present invention, there is provided a separation and extraction device comprising:

a supporting unit configured to support a stack of sheets;

a vibrator which is in contact with a sheet surface of the stack, configured to apply a spot vibration on the sheet surface of the stack at high frequency to separate the sheets of the stack;

a sheet extraction mechanism configured to extract a sheet or sheets from the sheet surface of the stack and convey the sheet or sheets sequentially; and a separating mechanism configured to separate one sheet from the other sheet or sheets and convey the one sheet.

According to an another aspect of the present invention, there is provided a method of separating a sheet from a stack of sheets to extract the sheet from the stack, comprising:

supporting a stack of sheets;

applying a spot vibration on a sheet surface of the stack at high frequency to separate the sheet or sheets of the stack;

extracting a sheet or sheets from the sheet surface of the stack and conveying the sheet or sheets sequentially;

separating one of the sheet or sheets from the other sheet or sheets and convey the one of the sheet.

DETAILED DESCRIPTION OF THE INVENTION

With reference to the drawings, description will be given of separation and extraction devices according to several embodiments of the present invention.

Figure 1:
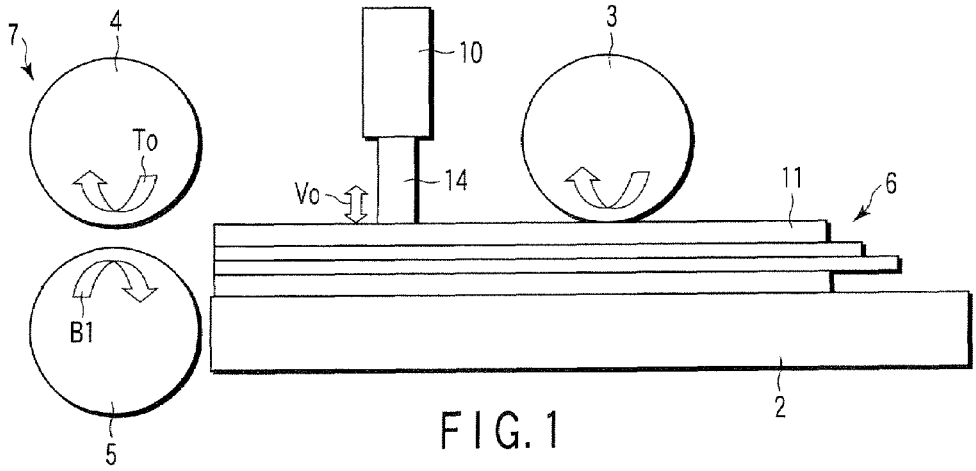
FIG. 1 is a side view schematically showing a separation and extraction device according to a first embodiment of the present invention.
Figure 2:
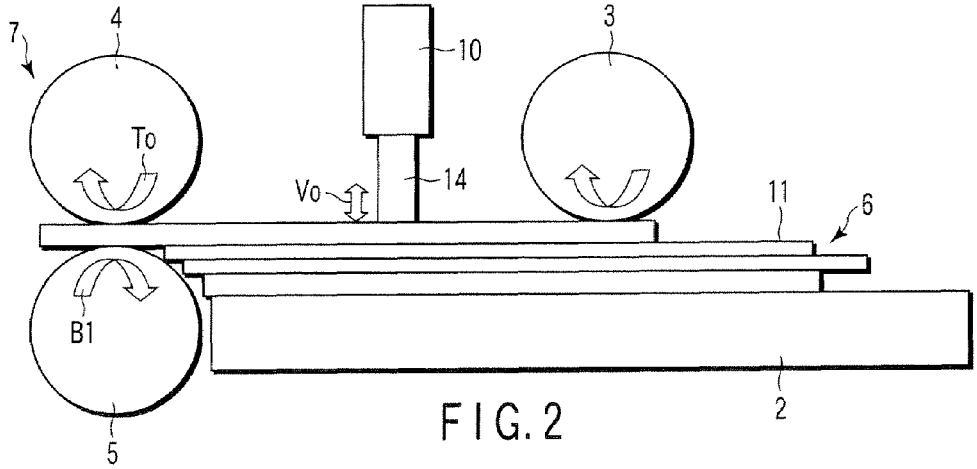
FIG. 2 is a side view schematically showing a sheet separation and extraction operation of the separation and extraction device shown in FIG. 1.

FIG. 1 is a schematic view showing the separation and extraction device according to a first embodiment of the present invention. FIG. 2 is a schematic diagram showing an operation performed by the separation and extraction device shown in FIG. 1 to separate and extract a sheet 11 from a sheet stack.

The separation and extraction device shown in FIGS. 1 and 2 comprises a sheet feeding board 2 on which sheets (paper-like media) are stacked, that is, a stack 6 is placed. A vibrator 10 is placed on the stack 6; the vibrator 10 comprises an ultrasonic horn 14 that vibrates the stack of sheets 11, which readily adhere to one another. A feed roller 3 is also provided on the stack 6; the feed roller 3 serves as a feed mechanism that conveys the sheets 11. The sheets 11 are fed along the sheet feeding board 2 and then stacked on the sheet feeding board 2. The top surface of the stack 6 is in contact with the feed roller 3. Rotation of the feed roller 3 causes a frictional force between the feed roller 3 and the uppermost sheet (paper-like media) 11 of the stack 6 to extract this sheet. The sheet is then brought into a sheet processing apparatus (not shown) via a separating mechanism 7 that prevents the sheets from overlapping one another.

The separating mechanism 7 is composed of a forward rotating roller 4 (conveying roller) that rotates in a direction in which the sheets 11 are conveyed and a backward rotating roller 5 (separating roller) which separates the overlapping sheets 11 from one another and which then returns them to the sheet feeding board 2. The forward rotating roller 4 and backward rotating roller 5 are arranged parallel to each other so as to have a given gap between the rollers 4 and 5. The gap is set at a value smaller than that of the thickness of two sheets 11. Thus, when the overlapping sheets 11 are passing through the rollers 4 and 5, all the sheets other than the uppermost one are returned to the stack 6 by the backward rotating roller 5, located at the bottom of the separating mechanism 7. This prevents these sheets from being brought into the apparatus.

In the separation and extraction device shown in FIG. 1, when rotated as shown by arrow To in FIG. 2, the feed roller 3 brings out a sheet to the separating mechanism 7, placed in the conveying direction. The separating mechanism 7 separates the sheets 11 fed to between the forward rotating roller 4 and the backward rotating roller 5, from one another, and conveys one of the sheets to a processing unit (not shown). In the separating mechanism 7, shown in FIG. 2, to feed the sheet 11 in the conveying direction, the forward rotating roller 4 is rotated as shown by arrow TO, while the backward rotating roller 5 is rotated in a direction opposite to the direction in which the forward rotating roller 4 is rotated, as shown by arrow B1. Accordingly, if a plurality of sheets 11 are supplied to the separating mechanism 7 via the feed roller 3, the uppermost sheet 11 is fed out forward by the forward rotating roller 4. The sheets 11 in contact with the backward rotating roller 5 are returned in the direction opposite to the conveying direction. If one sheet is supplied to the separating mechanism 7 via the feed roller 3, it is fed out forward by the forward rotating roller 4 against the rotational frictional force of the backward rotating roller 5. This is because the frictional force between the forward rotating roller 4 and the sheet 11 is stronger than that between the backward rotating roller 5 and the sheets 11.

The above configuration avoids bringing overlapping sheets 11 into the processing apparatus. The forward rotating roller 4 and backward rotating roller 5 need not necessarily be arranged with the given gap between them as shown in FIGS. 1 and 2. A mechanism such as a spring may be used to apply a pressing force to the backward rotating roller 5 and thus to the surface of the sheets 11 conveyed by the backward rotating roller 5. The mechanism applying the spring force to the backward rotating roller 5 is particularly effective for overlap prevention that enables a sheet 11 to be brought out from a bundle of a mixture of sheets 11 of different thicknesses.

As shown in FIGS. 1 and 2, the vibrator 10 contacts the uppermost sheet 11 of the stack 6 from above the stack 6. The vibrator 10, comprising the ultrasonic horn 14, has its leading end vibrated in a direction V0 substantially perpendicular to the surface of the stack 6.

Figure 3:
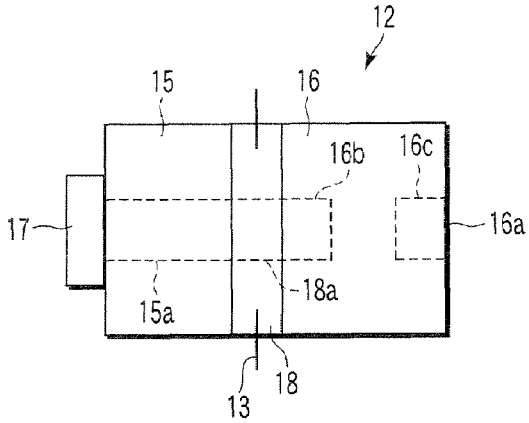
FIG. 3 is a side view schematically showing a vibrating member of a vibrator shown in FIGS. 1 and 2.
Figure 4:
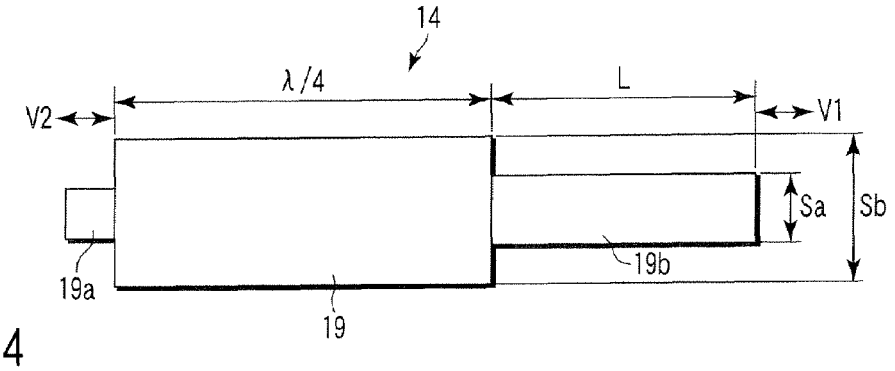
FIG. 4 is a side view schematically showing an ultrasonic horn of the vibrator shown in FIGS. 1 and 2.

In FIGS. 1 and 2, which are simplified views of the vibrator 10, a vibrating member 12 such as the one shown in FIG. 3 is connected to the ultrasonic horn 14 shown in FIG. 4. As shown in FIG. 3, the vibrating member 12 is what is called a bolt tightened vibrating member and has a piezoelectric ceramic portion 18 tightened between a pair of blocks 15 and 16 with a bolt 17. The piezoelectric ceramic portion 18 functions as a piezoelectric element and has electrodes 13 projecting out from the piezoelectric ceramic portion 18. Through-holes 15*a* and 18*a* are formed in central portions of the cylindrical block 15 and disk like piezoelectric ceramic portion 18 and are threaded so that a bolt 17 can be fitted into the through-holes 15*a* and 18*a*. A recessed hole 16*a* is formed in a central portion of piezoelectric ceramic portion 18 side of the cylindrical block 16. The recessed hole 16*b* is threaded so that the bolt 17 can be fitted in the recessed hole 16*b*. The bolt 17 is fitted and tightened in the through holes 15*a* and 18*a* in the cylindrical block 15 and disk-like piezoelectric ceramic portion 18 and in the recessed hole 16*b* in the cylindrical block 16. This mechanically connects the cylindrical block 15 and disk-like piezoelectric ceramic portion 16 together.

When the vibrating member 12 is vibrated in accordance with a driving voltage applied to the electrode 13 by the disk-like piezoelectric ceramic portion 18, the whole vibrator 10 vibrates. The resulting vibration is transmitted to a vibrating surface 16*a* of the cylindrical block 16. The piezoelectric ceramic portion 18 offers relatively small amplitude. Consequently, even if ultrasonic vibration is obtained from the vibrating surface 16*a* of the cylindrical block 16 and provided to the surface of the stack 6, the stack 6 cannot be provided with vibration sufficient to loosen the sheets 11. Therefore, the vibrator 12 is mechanically coupled to the ultrasonic horn 14 in order to amplify the ultrasonic vibration.

To allow the ultrasonic horn 14, shown in FIG. 4, to be mechanically coupled, a threaded recessed hole 16*c* is formed in the vibrating surface 16*a* of the cylindrical block 16. A coupling portion 19*a* that is fitted in the recessed hole 16*c* is formed on one end surface of a cylindrical block portion 19 of the ultrasonic horn 14. The coupling portion 19*a* is fitted in the recessed hole 16*c* to allow the cylindrical block 16 and the cylindrical block portion 19 to adhere to each other for integral coupling. The overall length of the cylindrical block portion 19 is specified to be one fourth of a substantially vibration wavelength λ. An extending portion 19*b* extends from the other end surface of the cylindrical block portion 19; the extending portion 19*b* has a smaller diameter Sa than that Sb of the cylindrical block portion 19. The leading end of the extending portion 19*b* is formed flat so as to abut against the sheets 11. In the ultrasonic horn 14, the vibration transmitted by the cylindrical block portion 19 can have its amplitude changed by the extending portion 19*b* and can then be transmitted to the sheets. This is because the other end of the cylindrical block portion 19 is positioned at a vibration modal (λ/4) and because the extending portion 19*b* extending from the other end of the cylindrical block portion 19 has a larger or smaller diameter than the cylindrical block portion 19.

With the ultrasonic horn 14 configured as described above, the vibration speed at the leading end of the ultrasonic horn 14 is amplified so that V1/V2=Sb/Sa. The ultrasonic horn 14 configured as described above enables an increase in the amplitude of the vibration at the leading end to sufficiently accelerate the sheets 11. Reference character V2 denotes the vibration speed transmitted to the cylindrical block 16. Reference character V1 denotes the vibration speed output from the leading end of the ultrasonic horn 14.

Experiments were carried out with the diameter Sa of the leading end set at 5 mm and with the 20-mm ultrasonic horn 14 coupled to the 20×60-mm vibrating member 12. The experiments show that the vibration amplification rate Sb/Sa of the ultrasonic horn 14 is doubled. The experiments also show that a friction reducing effect is highest at Sa=5 mm. This indicates that the increased diameter of leading end of the ultrasonic horn 14 results in relative enhancement of in-plane vibration components, thus hindering axial vibration components contributing to the vibration. In contrast, since the ultrasonic horn 14 is in contact with the sheets 11, contact pressure decreases with increasing diameter Sa under a fixed pressing force. This avoids possible damage to the media. It has been confirmed that the friction reducing effect is not exerted only by the vibrating member 12 free from the ultrasonic horn 14. In practical design, the diameter Sa of horn leading end is effectively set at about 3 to 20 mm, more preferably at 5 to 10 mm. A decrease in this value increases pinpoint contact pressure to allow ultrasonic waves to easily enter the sheets 11. However, this structure is likely to damage the surface of the paper-like media and is thus impractical. An excessively large leading end diameter results in a relative decrease in contact surface pressure to hinder ultrasonic waves from entering the sheets. Experiments show that a horn leading end diameter Sa of about 5 to 10 mm enables the easiest construction and is most effective.

The ultrasonic horn 14 of the vibrator 10 described above is pressed against the top of the bundle (stack) of the sheets 11. This has been found to sufficiently reduce the frictional force between the leading end of the ultrasonic horn 14 and the uppermost sheet 11 and between the uppermost sheet 11 and the underlying sheet 11. It has also been found that conveying the uppermost sheet under the above conditions enables the sheets to be separated from one another without extraction overlapping sheets.

Figure 5:
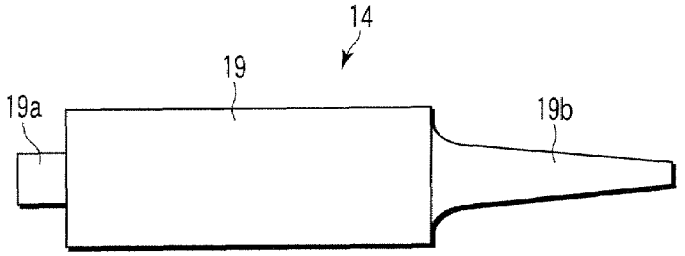
FIG. 5 is a side view schematically showing a variation of the ultrasonic horn shown in FIG. 4.
Figure 6:
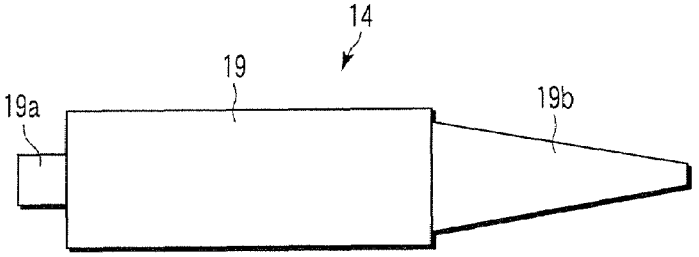
FIG. 6 is a side view schematically showing another variation of the ultrasonic horn shown in FIG. 4.

A suitable material for the ultrasonic horn 14 is a titanium alloy which is hard and unlikely to undergo fatigue fracture. An aluminum alloy, a nickel alloy, or the like can also be used depending on use frequencies or conditions. The shape of the ultrasonic horn 14 is not limited to the larger-diameter cylindrical block and smaller-diameter cylindrical block coupled together on the same axis via a step as shown in FIG. 4. The diameter of the extending portion 19*b* may decrease gradually as shown in FIGS. 5 and 6, rather than rapidly. In other words, the extending portion 19*b* may be tapered so that its diameter gradually decreases from the cylindrical block 19 so as to draw a circular arc as shown in FIG. 5. Alternatively, the extending portion 19*b* may be tapered so that its diameter linearly decreases.

The leading contact portion of the ultrasonic horn 14 is generally flat. However, the leading contact portion is likely to damage the media, offer resistance to conveyance, or be caught in a step between media such as envelopes. The leading contact portion may thus be rounded. The leading contact portion preferably has few recesses and protrusions on its surface so as to slide smoothly on the sheets.

Figure 7:
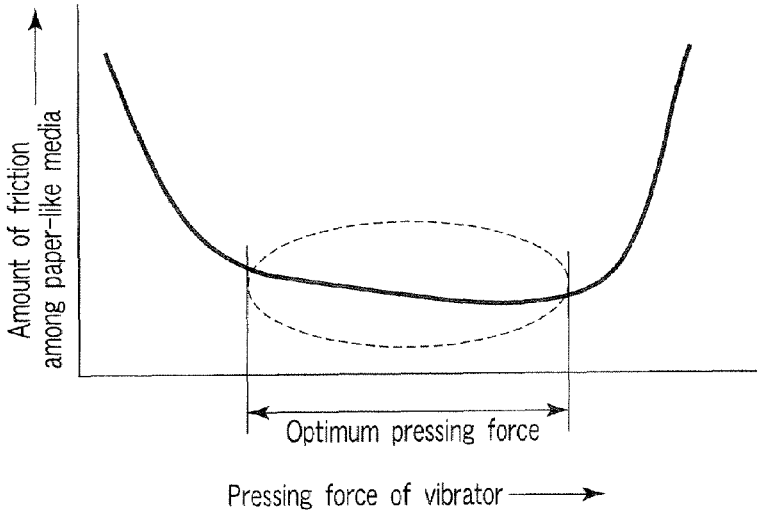
FIG. 7 is a graph showing the relationship between the pressing force of the vibrator shown in FIGS. 1 and 2 and the amount of friction among the sheets.

The vibrator is preferably vibrated at a vibration frequency of at least 10 KHz and contacted with the sheets 11 under a contact force of at least 200 gf and at most 1 kgf. More specifically, the vibrator 10 having the ultrasonic horn 14 with a leading end diameter of 3 to 10 mm is contacted with the stack 6 while being operated at a vibration frequency of 10 to 80 kHz and an amplitude of 5 to 50 μmp-p. It has been found that under these contact conditions, using the vibrator 10 to vibrate the surface of the stack 6 reduces the friction among the sheets 11 (paper-like media) to allow one of the sheets to be very easily brought out. FIG. 7 shows the relationship between the amount of friction among the paper-like media and the pressing force of the vibrator 10. The inventors' experiments show that if an optimum pressing force such as the one shown in FIG. 7 is applied to the paper-like media, the adhesion among the bundled sheets 11 decreases to half to one-fifth, thus excellently preventing overlapping sheets 11 from being brought out.

As shown in FIG. 2, the sufficiently loose sheets (paper-like sheets) are conveyed until they reach the separating mechanism 7 comprising the overlap preventing function. This prevents the device from, for example, being locked when a bundle of adhesively overlapping sheets is brought out from the bundle. If the vibrator is formed like a horn to apply a spot vibration, it enables a significant reduction in the quantity of energy required to vibrate the sheets at the same amplitude compared to bar-like vibrators. The inventors' experiments show that the bar scheme requires at least 100 W, whereas the horn-like vibrator consumes power of only 10 to 40 W in order to obtain a sufficiently effective amplitude. During vibration, the scheme of using a horn to apply a spot vibration enables the contact to concentrate at a small point. This makes it possible to increase the efficiency with which vibration propagates to the sheets (paper-like media) 11. The size of the horn leading end can be varied depending on design. A practical size is such that the leading end diameter ϕ is about 10 to 30 mm as already described. If the leading end is formed to be rectangular for an arrangement reason, the appropriate size is up to about 60 mm in a longitudinal direction.

In the arrangement shown in FIG. 2, the sheet feeding table 2 may be placed perpendicularly to the direction of gravity so that the sheets 11 can be moved perpendicularly to the direction of gravity. Even this arrangement can produce similar effects. This arrangement prevents the weight of the stack 6 from being placed on the sheet feeding table 2. The sheets 11 (paper-like media) are "upright" with respect to the gravity when brought into the processing apparatus.

Figure 8:
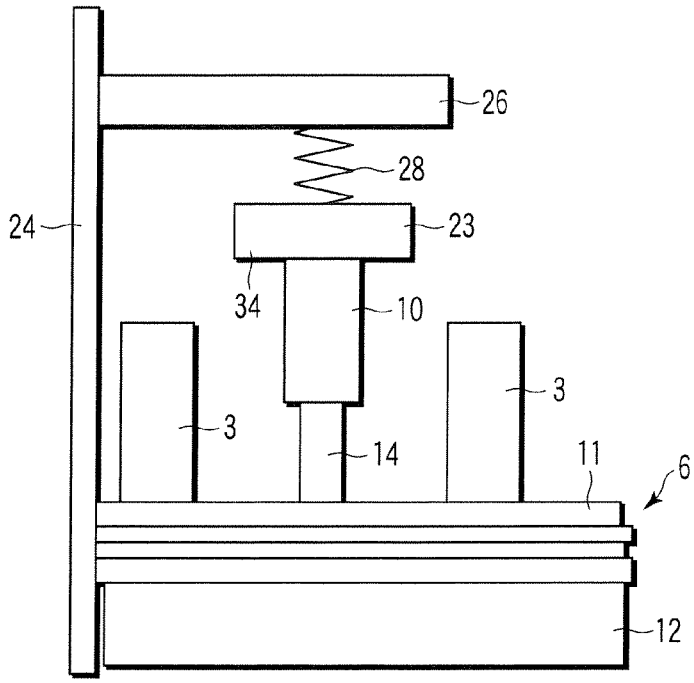
FIG. 8 is a front view schematically showing a separation and extraction device according to a second embodiment of the present invention.
Figure 9:
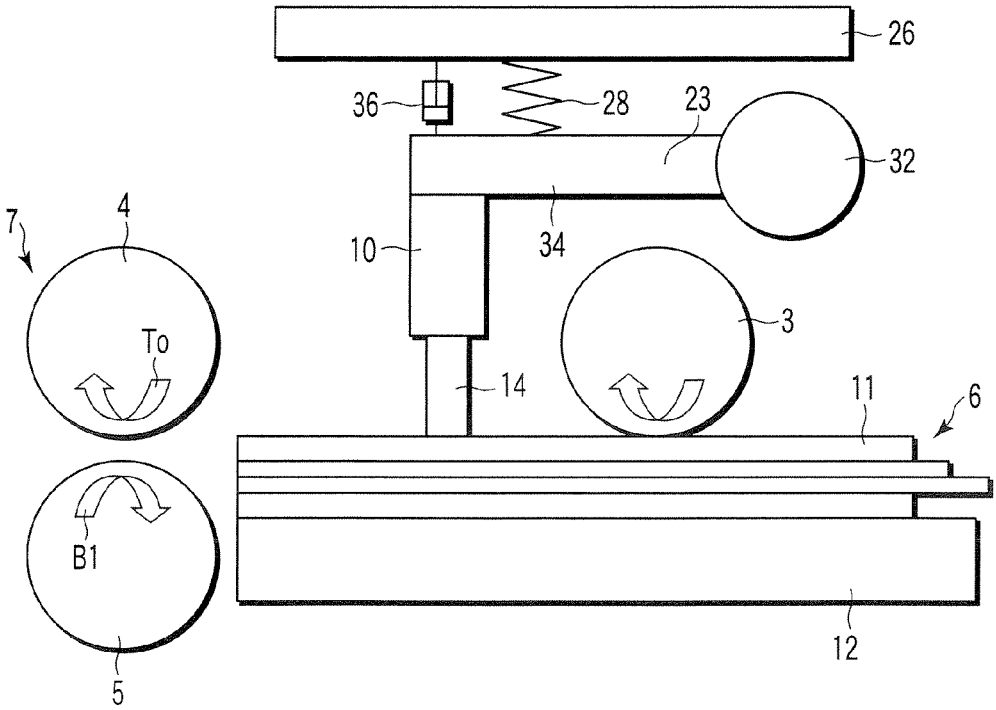
FIG. 9 is a side view schematically showing the separation and extraction device shown in FIG. 8.

With reference to FIGS. 8 and 9, description will be given of a separation and extraction device according to a second embodiment of the present invention.

The separation and extraction device shown in FIG. 2 may be inappropriate depending on the type of the sheets 11 (paper-like media). For example, if the sheets 11 (paper-like media) are envelopes or the like, the bundle has a different thickness, which prevents the uppermost sheet of the stack 6 from being precisely positioned. Consequently, the top surface of the bundle of sheets may strike the fixed vibrator 10 too hard or almost no contact force may be exerted. As shown in FIG. 7, the efficiency has a close relationship with the contact force exerted between the surface of the vibrator 10 and the sheets 11 (paper-like media). A contact force exceeding the optimum range prevents a sufficient vibration from being transmitted to the sheets 11 (paper-like media). An excessively strong contact force may lock the leading end of the vibrator 10 to prevent its vibration. The surface of the sheets 11 (paper-like media) is not a perfectly flat surface but often has various recesses and protrusions. A bundle of bills or the like often has a markedly bent surface, which poses a similar problem.

FIGS. 8 and 9 show the separation and extraction device according to the second embodiment of the present invention, which can solve the above problem. As shown in FIGS. 8 and 9, the separation and extraction device comprises a rotary holding mechanism 23 (rotary pressing mechanism). The rotary holding mechanism 23 has a spring support structure such that the contact force of leading end of the ultrasonic horn 14 falls within the range of the optimum values shown in FIG. 7 when the vibrator 10 is rotatable in a vertical direction substantially orthogonal to the surface of the sheets and when the uppermost surface of the sheets is at a predetermined height. Specifically, as shown in FIGS. 8 and 9, a rotating shaft 32 is rotatably fixed to a device housing 24. A support arm 34 is fixed to the rotating shaft 32 and has the vibrator 10 fixed substantially at its leading end so as to hang from the support arm 34. As shown in FIGS. 8 and 9, the support arm 34 is coupled to a spring 28 and a damper 36 both fixed to a support bar 26 fixed to the housing 24. The spring 28 applies a spring force to the support arm 34 to press the vibrator 10, fixed to the support arm 34, against the sheets.

In the rotary holding mechanism 23, shown in FIGS. 8 and 9, the support arm 34 is rotatably supported around the rotating shaft 32, with the spring force exerted on the support arm 34. This causes the vibrator 10, fixed to the support arm 34, to be pressed against the sheets 11. The optimum range of the pressing force is between 200 and 1,000 gf. An insufficient contact force reduces the efficiency with which ultrasonic waves are transmitted to the media. However, an excessive strong contact force increase the friction between sheets thus disadvantageously hindering a single sheet from being brought out.

Figure 10:
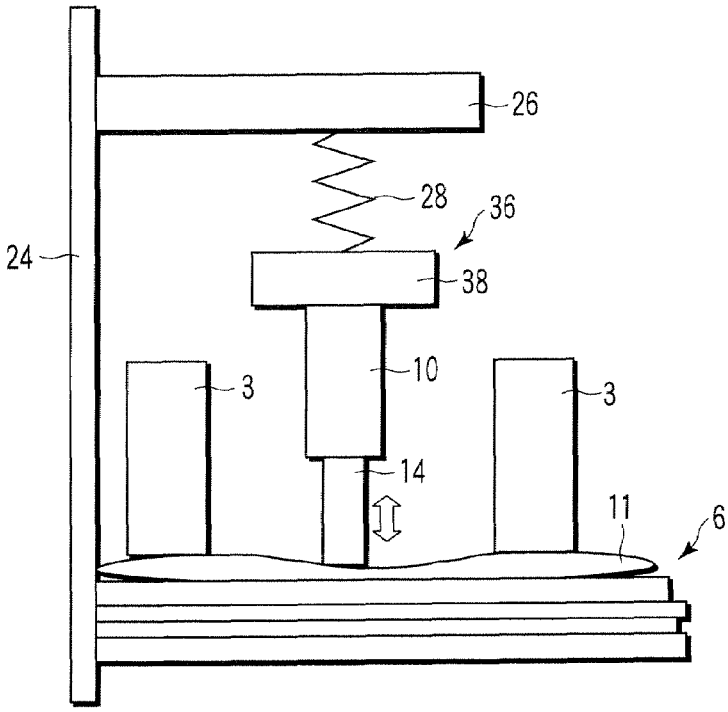
FIG. 10 is a front view schematically showing a separation and extraction device according to a third embodiment of the present invention.
Figure 11:
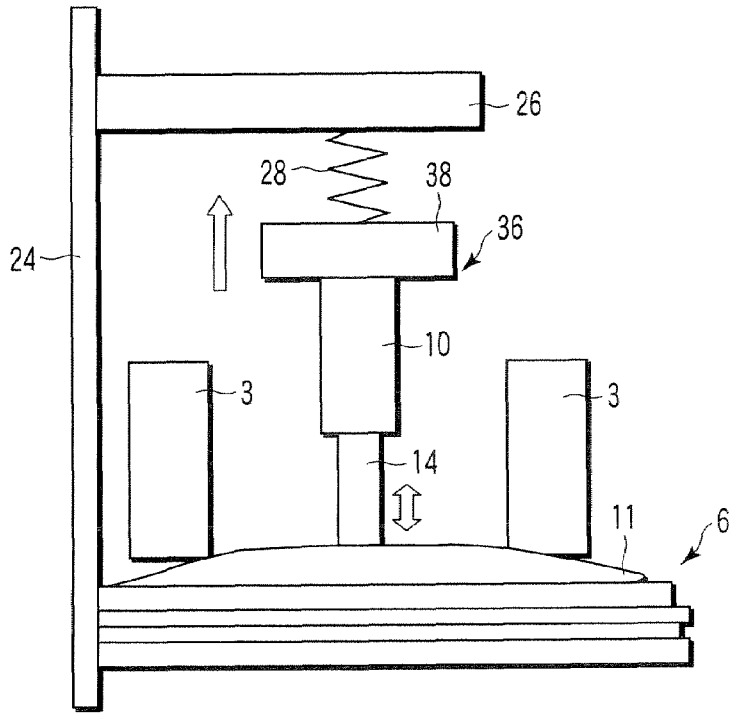
FIG. 11 is a side view of the separation and extraction device shown in FIG. 10.

The above values are thus experimentally determined. The rotary holding mechanism 23, shown in FIGS. 8 and 9, may be replaced with a direct-acting holding mechanism 36 such as the one shown in FIGS. 10 and 11. Specifically, the vibrator 10 may be fixed to a support block 38 replacing the support arm 34. The support block 38 may be fixed to the support bar 26 via the spring 28. With the direct-acting holding mechanism 36, the sheet feeding board 12 is raised to press the stack 6 against the vibrator 10 to apply a predetermined spring force to the stack 6. That is to say, the spring of the direct-acting holding mechanism 26 is deformed to cause a contact force between the vibrator 10 and the stack 6. For example, even if the top surface of the stack bundle slightly rises as it is, the direct-acting holding mechanism 36 allows the vibrator 10 to escape upward to prevent a possible excessively strong contact force. This enables the appropriate contact force to be maintained regardless of the position of top surface of the stack 6. As shown in FIGS. 10 and 11, the separation and extraction device employing the direct-acting holding mechanism 36 produces effects similar to those of the already described separation and extraction device even with a bundle of sheets such as envelopes which has a different thickness.

Figure 12:
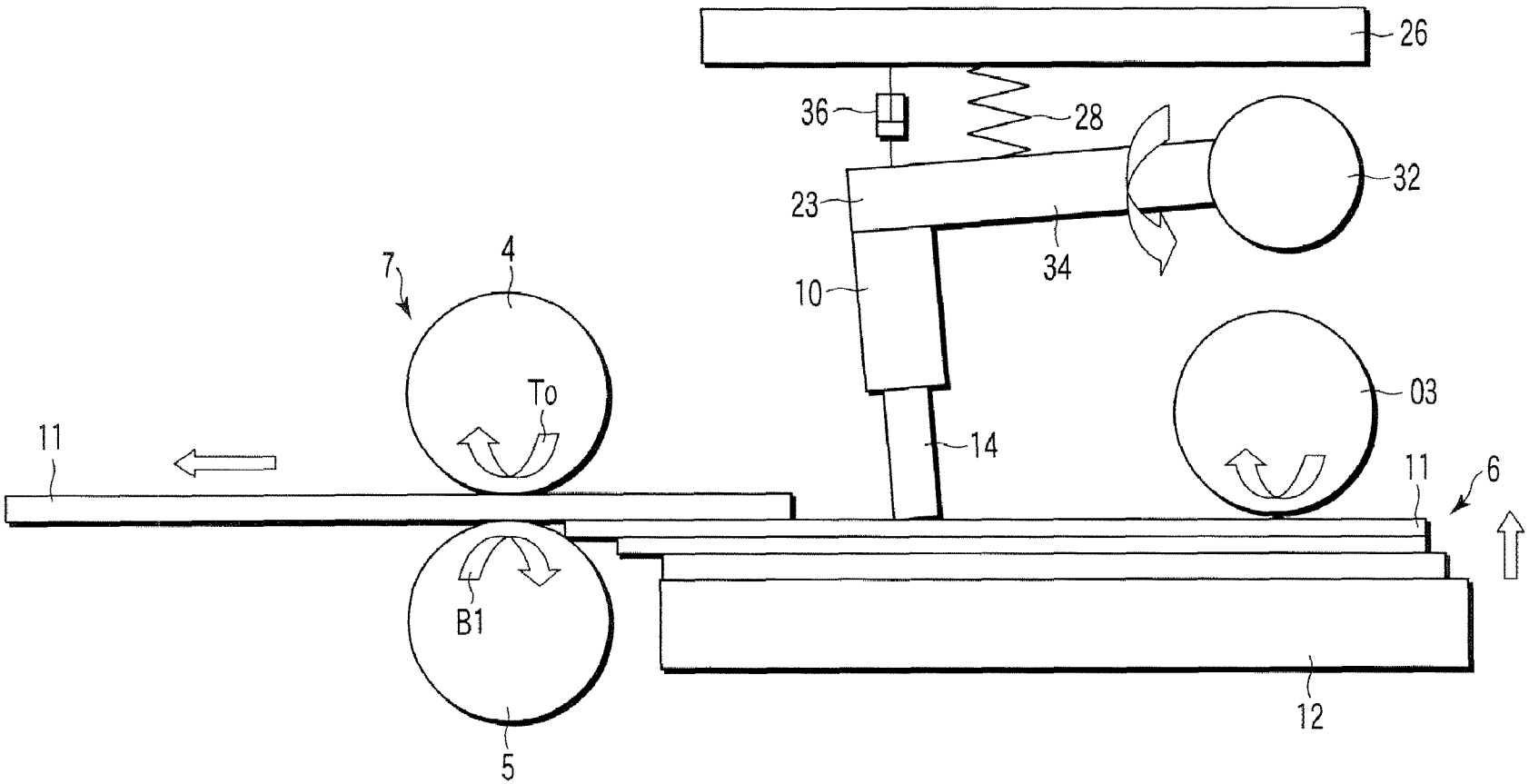
FIG. 12 is a side view schematically showing a variation of the separation and extraction device shown in FIGS. 8 and 9.

As shown in FIG. 12, even if a step is created on the surface of the stack 6 while a sheet 11 (paper-like media) is being brought out, the rotary holding mechanism 23 or direct-acting holding mechanism 36 quickly presses the vibrator 10 against the media surface. This enables a stable friction reducing operation to be continuously performed on the stack 6. The separation and extraction device can be additionally provided with a mechanism that can maintain a predetermined contact force while allowing the vibrator 10 to follow the shape of the media surface.

Figure 13:
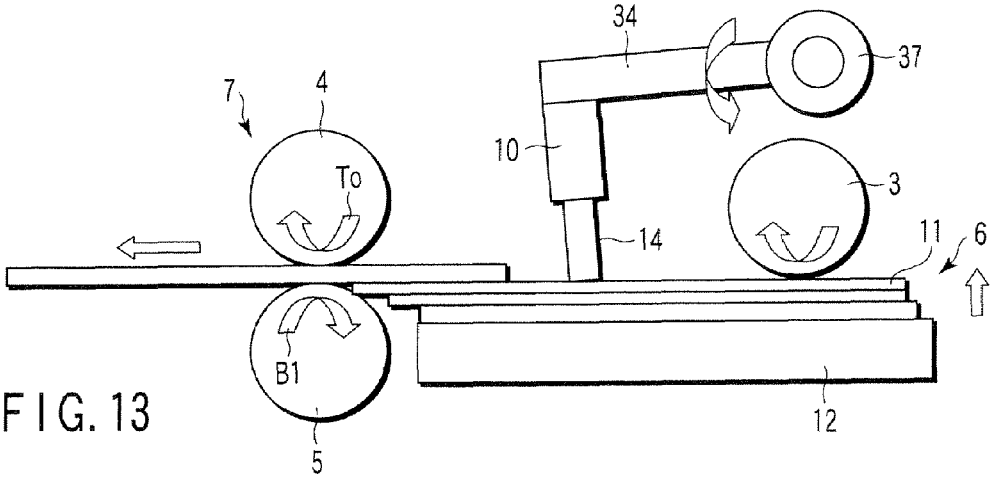
FIG. 13 is a side view schematically showing a variation of the separation and extraction device shown in FIGS. 8 and 9.
Figure 14:
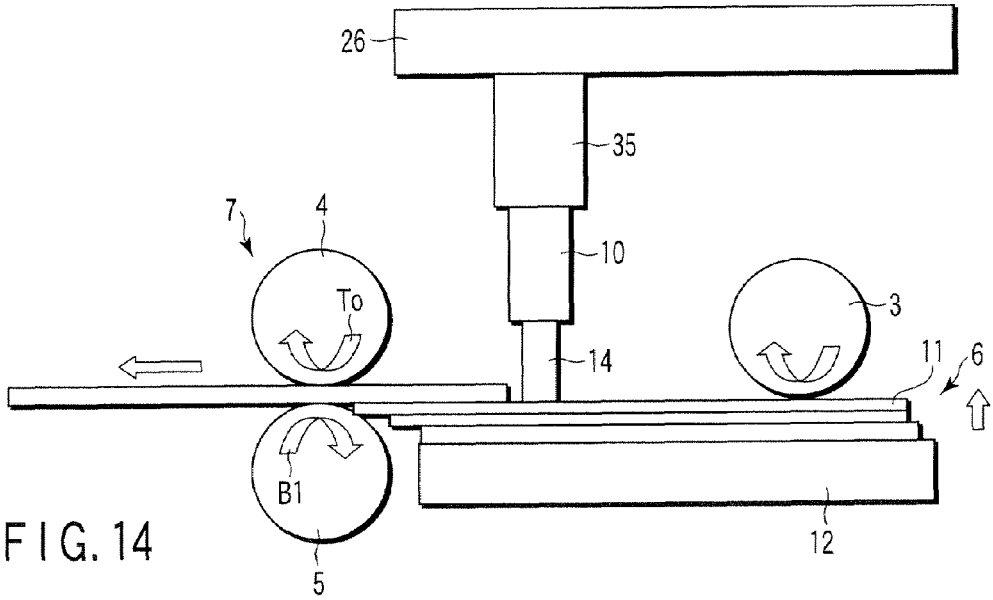
FIG. 14 is a side view schematically showing a variation of the separation and extraction device shown in FIGS. 10 and 11.

As shown in FIGS. 13 and 14, an actuator such as a torque motor may be used instead of the spring that generates a pressing force as shown in FIGS. 10 to 12. The spring support structure shown in FIGS. 10 to 12 is simple. However, owing to the natural frequency of the spring, when the sheets 11 are conveyed at high speed, a vibrator 10 with a large mass disadvantageously cannot follow the surface of the surface of the sheets (paper-like media) at high speed. Further, the rotation range of the support arm 34 depends on and is regulated by the amount of expansion and contraction of the spring. Thus, disadvantageously, a wide rotation range is unavailable. This indicates that a significant deformation of the spring often markedly changes the load.

FIGS. 13 and 14 show a separation and extraction device according to a third embodiment of the present invention. The support arm 34, which supports the vibrator 10, can be moved by a torque motor 37 or the vibrator 10 is supported by a linear actuator 35. In the separation and extraction device shown in FIG. 13, driving the torque motor 37 tilts the support arm 34 to allow the vibrator 10 to apply the appropriate contact force to the surface of the paper-like media. In the separation and extraction device shown in FIG. 14, operating the linear actuator 35 moves the vibrator 10 in the vertical direction to apply the appropriate contact force to the surface of the paper-like media. The configuration shown in FIGS. 13 and 14 is not affected by the natural frequency of the spring or the regulation of movement. This enables the vibrator 10 to follow the surface of the paper-like media over a wide range at high speed and to apply a stable contact force to the paper-like media.

Figure 15:
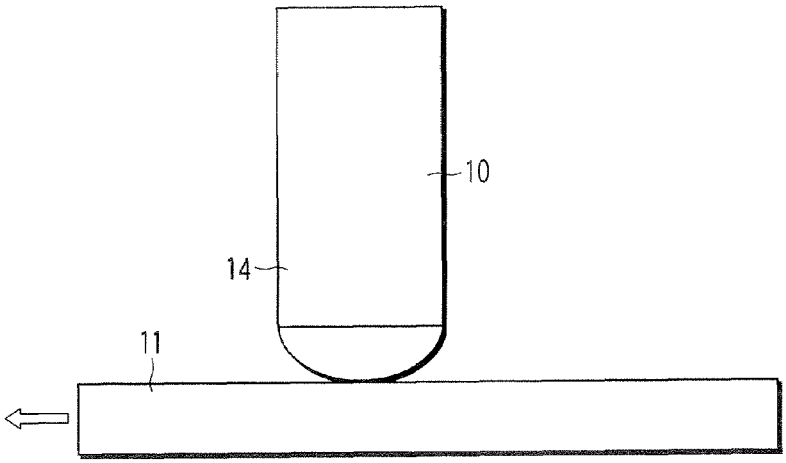
FIG. 15 is a side view schematically showing a variation of an ultrasonic horn in the separation and extraction device shown in FIGS. 8 to 14.

FIG. 15 shows a vibrator in a separation and extraction device according to a variation of the embodiments of the present invention, as well as the shape of leading end of the vibrator 10. The spherical surface of the leading end of the vibrator 10 prevents the vibrator 10 from being caught in a turndown part of an envelope. The separation and extraction device can thus more properly extract a sheet from the stack.

Figure 16:
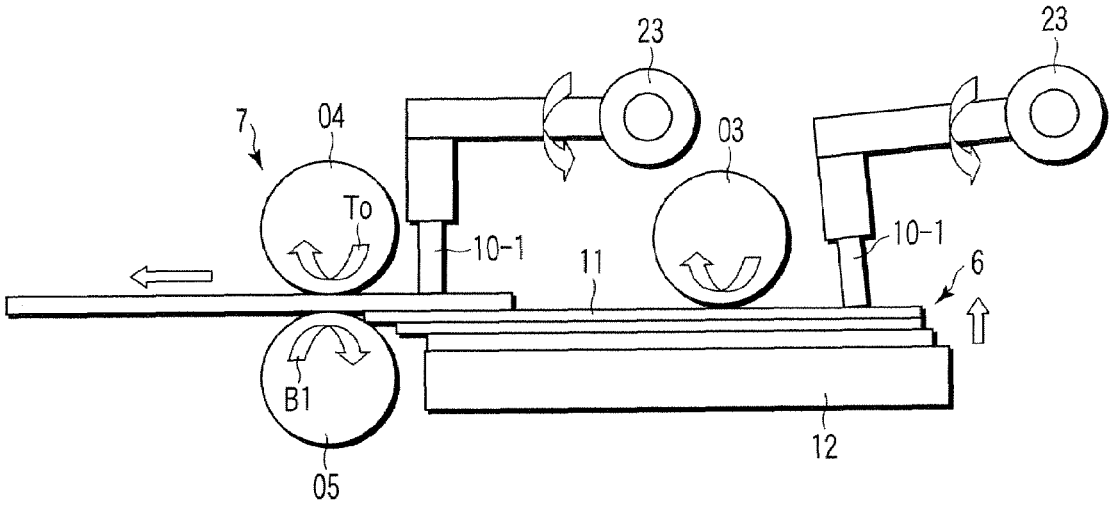
FIG. 16 is a side view schematically showing another variation of the separation and extraction device shown in FIGS. 8 and 9.

FIG. 16 shows a separation and extraction device according to a variation of the third embodiments of the present invention. Even the single vibrator 10 can exert a friction reducing effect over a sufficient area of the stack 6. However, the increased speed of the device moves the top paper-like media at a higher speed, thus requiring more effective vibration. The separation and extraction device according to the variation shown in FIG. 16 has two vibrators 10-1 and 10-2 arranged on the stack 6 along the conveying direction. The feed roller 03 is placed between the vibrators 10-1 and 10-2. With this arrangement, while the uppermost paper-like media is being brought out, the vibrator 10-2, located upstream in the conveying direction, can contact and vibrate the surface of the next paper-like media. The vibrator 10-1, located downstream in the conveying direction, vibrates the uppermost paper-like media. The vibrator 10-2, located upstream in the conveying direction, vibrates the paper-like media 11 located under the paper-like media being conveyed and which is to be conveyed next. The next paper-like media 11 is vibratingly separated from the stack 6. The separation and extraction device shown in FIG. 16 can simultaneously vibrate the uppermost sheet 11 and the next sheet 11 to be conveyed, during a sheet extraction operation. This enables the adhesion among the bundled sheets to be reliably reduced, even if the sheet is required to be conveyed at a high transporting rate or high speed operation.

Figure 17:
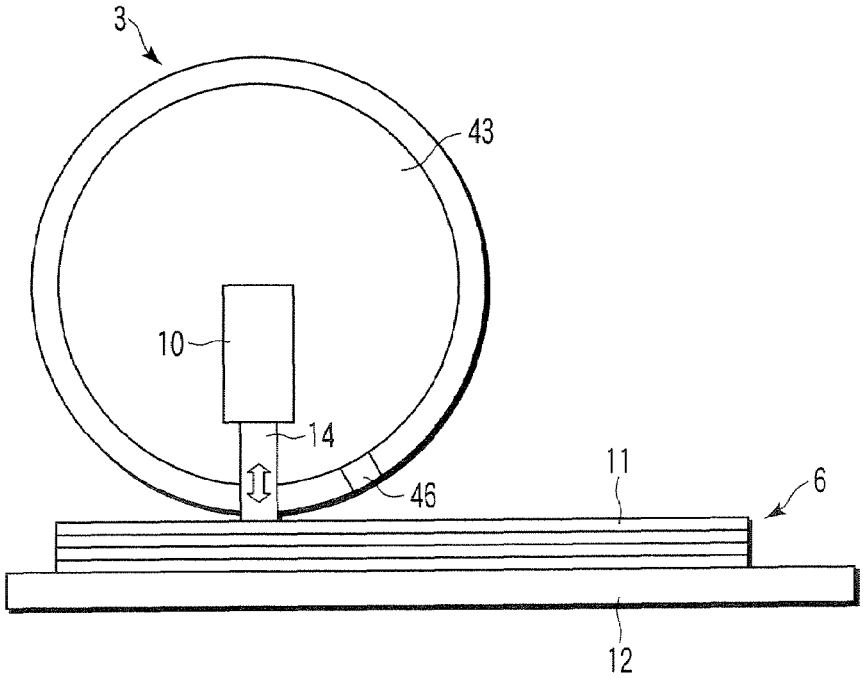
FIG. 17 is a side view schematically showing a separation and extraction device according to a fourth embodiment of the present invention.

FIG. 17 shows a separation and extraction device according to a fourth embodiment of the present invention. In the separation and extraction device shown in FIG. 17, stacked sheets 11 are fed from the bottom of the device along the sheet feeding board 12. The top surface of the sheets 11 is in contact with the vacuum suction feed roller 3 composed of a vacuum suction drum 43. Every time the feed roller 3 rotates and its internal notch portion 46 (suction portion) comes into contact with the sheets 11, sheets 11 are sucked and their leading ends are conveyed to the separation and extraction device. The sheets are then brought into the processing apparatus via the separating mechanism 7. The separating mechanism 7 is composed of the pair of the forward rotating roller 4 and backward rotating roller 5, arranged parallel to each other with the given gap between them. The gap is set at the value smaller than that of thickness of two sheets. Thus, when the overlapping sheets 11 are passing through the rollers 4 and 5, all the sheets other than the uppermost one are returned to the stack 6 by the backward rotating roller 5 and thus prevented from being brought into the apparatus. This prevents overlapping sheets from being brought into the apparatus.

In the separation and extraction device shown in FIG. 17, the vibrator 10 is in contact with the uppermost sheet of the stack 6. The sheets 11 are held on the sheet feeding board 12 and fed out in the extraction direction. The interior of the vacuum suction drum 43 is drawn to a vacuum and maintained at a negative pressure by a compressor, pump, or the like. This enables the sheet 11 to be sucked into a suction hole. The vacuum suction drum 43 is continuously or intermittently rotated by a motor or the like to feed the sheets 11 out into the apparatus via the separating mechanism 7 at a predetermined pitch.

As shown in FIG. 17, with its leading end in contact with the surface of the stack 6, the ultrasonic horn 14 of the vibrator 10 is vibrated substantially perpendicularly to the surface of the stack 6. The vibration frequency, amplitude, and leading end diameter are set at 10 to 80 kHz, 5 to 50 μmp-p, and 3 to 10 mm, respectively, as already described. Under these contact conditions, vibrating the surface of the stack 6 reduces the friction among the sheets to allow one of the sheets to be very easily brought out.

Figure 18:
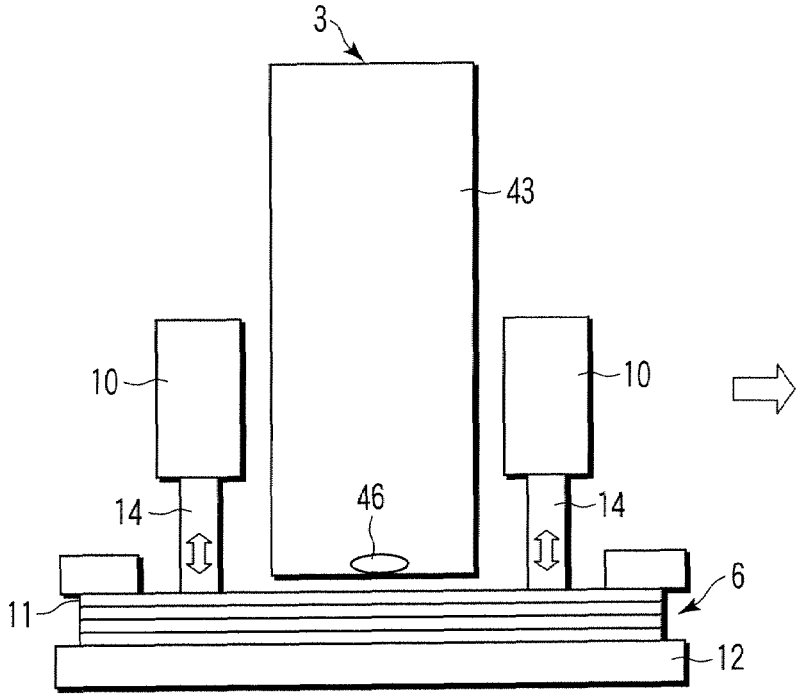
FIG. 18 is a front view of the separation and extraction device shown in FIG. 17.
Figure 19:
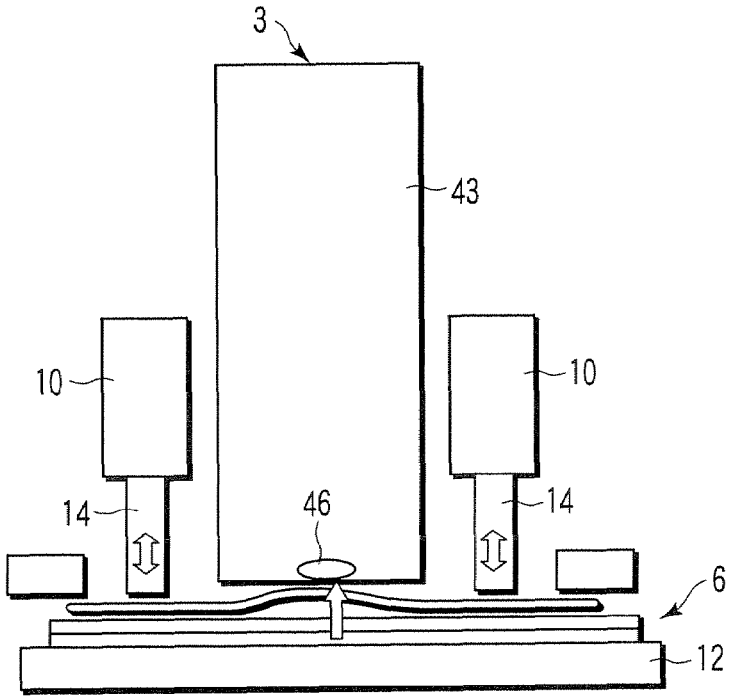
FIG. 19 is a side view schematically showing a sheet separation and extraction operation of the separation and extraction device shown in FIGS. 17 and 18.

As shown in FIGS. 18 and 19, the vibrators 10 are arranged on the respective sides of the vacuum suction feed roller 3. The leading end of the vibrator 10 is placed to contact the stacked media 11 more sufficiently than the vacuum suction drum 43. This creates a very small gap between the vacuum suction drum 43 and the stacked media 11. The stack 11 is pressed, by the sheet feeding board 12, against an extraction portion including a suction portion 46 of the vacuum suction feed roller 3. The stack 6 is brought into contact with the ultrasonic horn 14 before it meets with the vacuum suction drum 43. The surface of extract portion of the vacuum suction drum 43 is not flush with the leading end of the ultrasonic horn 14. There is a small difference in height (shift amount) between the surface of the extraction portion and the leading end of the ultrasonic horn 14. The shift amount is set between, for example, 0.1 and 5 mm.

As already described with reference to FIG. 7, the inventors' experiments show that the efficiency of friction reduction based on vibration has a close relationship with the contact force exerted between the surface of the vibrating member and the media. A contact force exceeding the optimum range prevents a sufficient vibration from being transmitted to the media. An excessively strong contact force may lock the leading end of the vibrating member to prevent its vibration. The separation and extraction device shown in FIG. 17 allows the contact force between the ultrasonic horn 14 and the paper-like media 11 to be appropriately controlled while a sheet 11 is being brought out. Ultrasonic waves can be more efficiently applied within the optimum range of pressure. This enables a sufficient reduction in the adhesion among the initially adhering sheets in the stack 6. Under these conditions, a negative pressure from the vacuum suction drum on the media allows the uppermost media to be easily separated from the remaining paper-like media. The uppermost media is deformed and sucked by the vacuum suction drum 43 as shown in FIG. 19. Then, rotating the drum 43 feeds the uppermost paper-like media 11 out into the apparatus, while preventing other overlapping media from being brought into the apparatus.

With the separation and extraction device shown in FIGS. 17 to 19, when the sheets 11 are sucked by the vacuum suction drum 43 before ultrasonic waves are transmitted to the sheets 11, an extraction operation is undesirably started before an adhesion reducing operation is. Thus, the ultrasonic horn 14 comes into contact with the paper-like media before the extraction portion does. The amount by which the ultrasonic horn 14 is shifted from the vacuum suction drum 43 desirably corresponds to a distance short enough to allow the suction force of the drum to suck the single media. This makes it possible to stabilize the quick separation carried out by the ultrasonic horn 14 and the vacuum suction drum 43.

Figure 20:
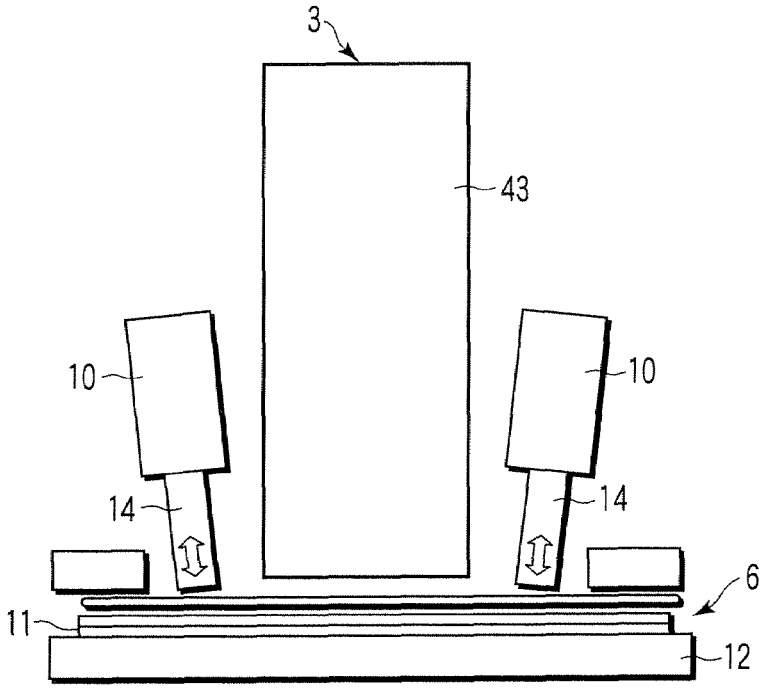
FIG. 20 is a front view schematically showing a separation and extraction device according to a fifth embodiment of the present invention.
Figure 21:
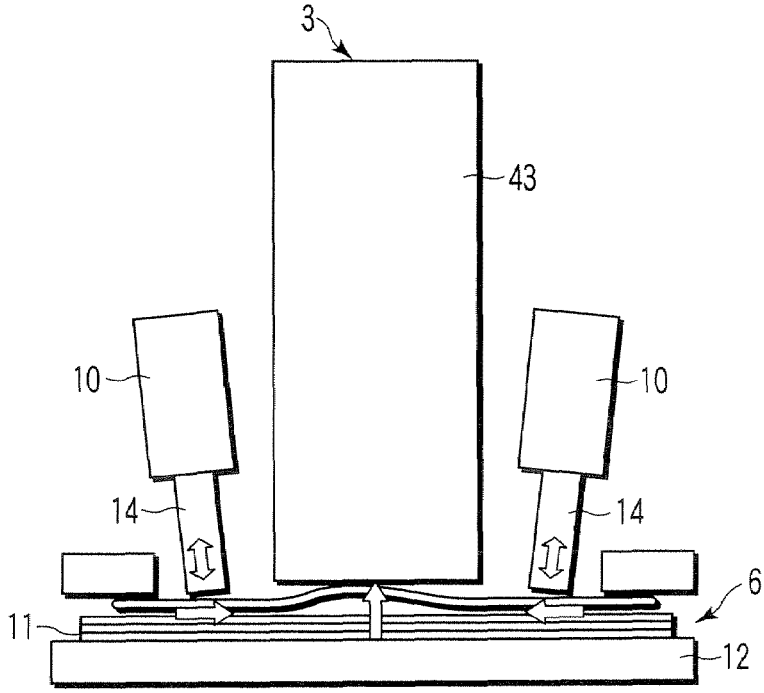
FIG. 21 is a front view schematically showing a sheet separation and extraction operation of the separation and extraction device shown in FIG. 20.

FIGS. 20 and 21 show a separation and extraction device according to a fifth embodiment of the present invention. The separation and extraction device shown in FIGS. 20 and 21 has the ultrasonic horns 14 arranged at the respective ends of the vacuum suction drum 43 and each having a leading end inclined toward the drum as shown in FIGS. 20 and 21. Each of the inclined ultrasonic horns 14 vibrates to generate an advancing component acting parallel to the surface of the sheets. This deforms the uppermost sheet 11 into a shape which is more readily sucked by the vacuum suction drum 43 and which varies depending on the flexibility of the sheets 11, as shown in FIG. 21.

Figure 22:
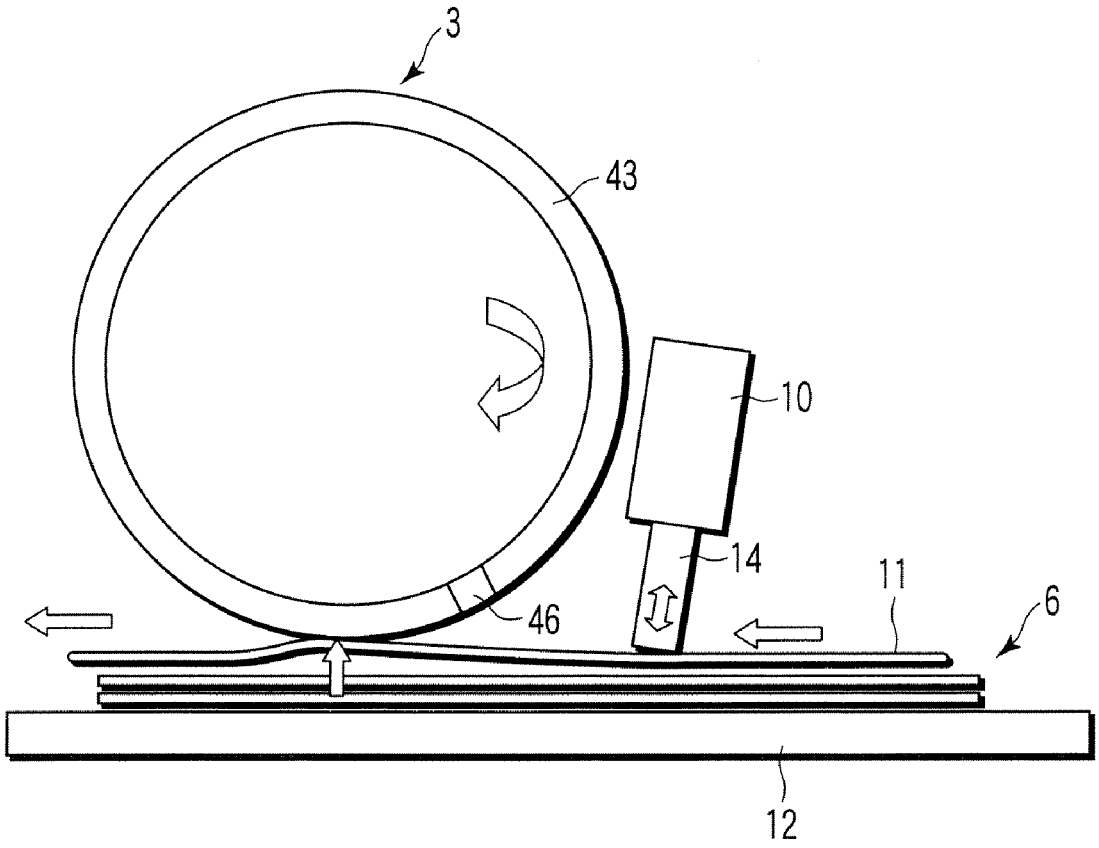
FIGS. 22 and 23 are side views schematically showing a sheet separation and extraction operation of the separation and extraction device shown in FIG. 21.
Figure 23:
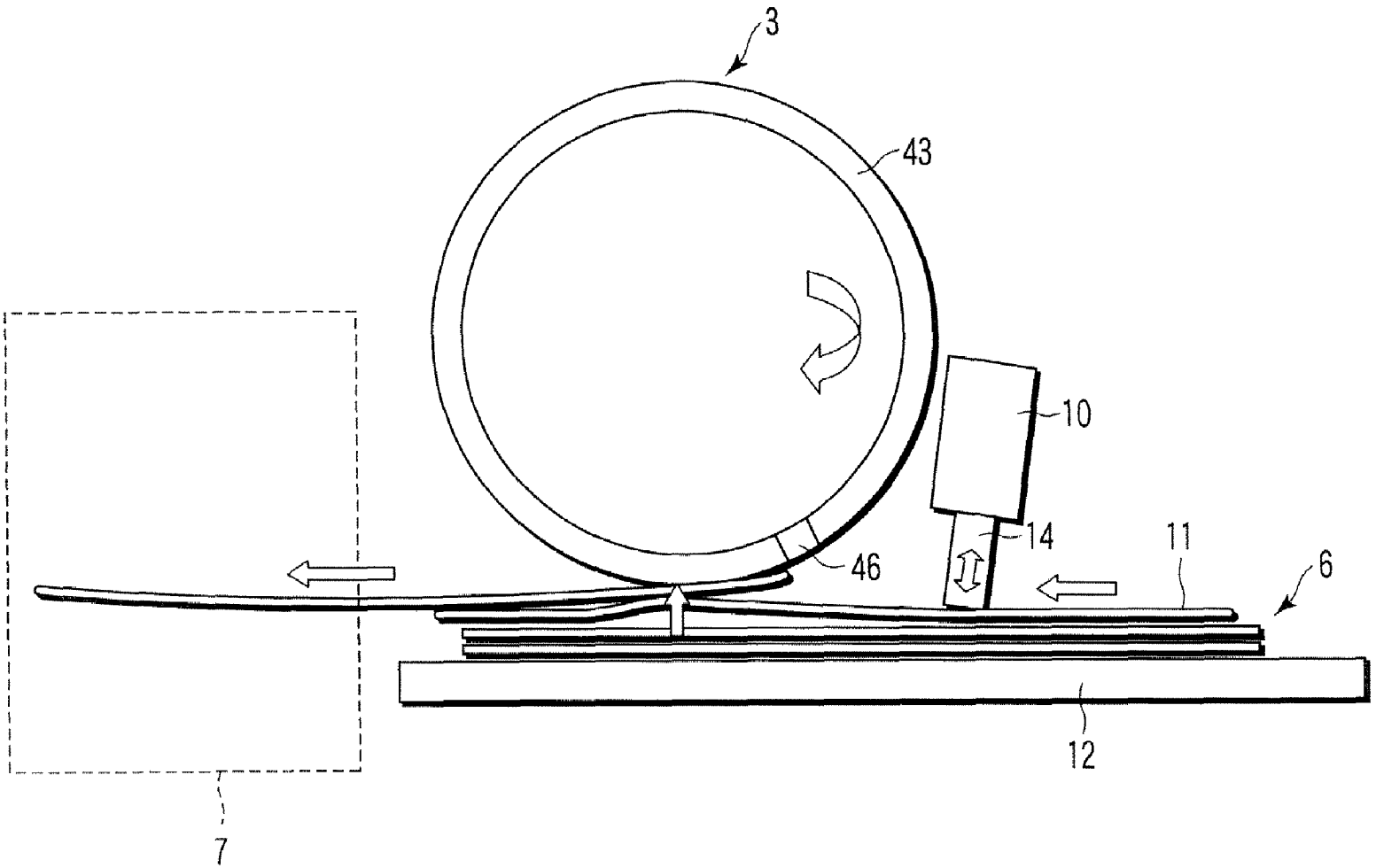

FIG. 22 is a separation and extraction device according to a sixth embodiment of the present invention. The separation and extraction device shown in FIG. 22 has the ultrasonic horn 14 inclined rearward with respect to the drum 43 in the extraction direction (downstream of the drum 43 in the conveying direction). With the arrangement shown in FIG. 22, the sheets can be deformed depending on the flexibility of the sheets 11 as is the case with the device shown in FIG. 21. In this arrangement, the ultrasonic horn is placed rearward in the sheet extraction direction. Consequently, after the uppermost sheet is brought out from the stack 6 and passes through the contact portion of the ultrasonic horn 14, the next sheet 11 to be brought out can be deformed as shown in FIG. 23. A sufficient time can be provided to deform the sheet to enable sheets to be consecutively brought out at a higher speed.

The separation and extraction devices of the present invention enable a reduction in the energy required for vibration. The separation and extraction devices can use the very efficient vibrator with reduced power consumption to reliably separatively extract a sheet from the stack without being affected by the shape of the sheets.

As described above, according to an embodiment of the present invention, there is provided a separation and extraction device that can very efficiently separate and extract a sheet from a stack with reduced power consumption and without being affected by the shape of the sheets.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A separation and extraction device, comprising:

a supporting unit configured to support a stack of sheets;

a vibrator configured to apply a spot vibration on the sheet surface of the stack, the vibrator including a vibrating member generating a high frequency vibration having a frequency which is not smaller than 10 kHz and an ultrasonic horn coupled to the vibrating member and amplifying the high frequency vibration thereof, the ultrasonic horn having a leading end which is in spot-contact with a uppermost sheet of the stack to apply the high frequency vibration on the sheet surface of the stack from the ultrasonic horn to separate the sheets of the stack;

a sheet extraction mechanism configured to extract a sheet or sheets from the sheet surface of the stack and convey the sheet or sheets sequentially;

a separating mechanism configured to separate one sheet from the other sheet or sheets and convey the one sheet; and a holding mechanism configured to hold the vibrator so that the vibrator can be moved in the direction substantially orthogonal to the surface of the sheets, the holding mechanism contacting the vibrator with the surface of the sheets under a predetermined contact force.

2. The device according to claim 1, wherein the sheet extraction mechanism includes a feeding mechanism configured to feed the sheet by a frictional force applied between the sheet surface of the stack and the feeding mechanism.

3. The device according to claim 1, wherein the vibrator comes into contact with the surface of the sheets under the predetermined contact force to vibrate the sheets in a direction substantially orthogonal to the surface of the sheets.

4. The device according to claim 1, wherein the vibrator is vibrated at a vibration frequency of at least 10 KHz.

5. The device according to claim 1, wherein the vibrator is contacted with the sheets under a contact force of at least 200 gf and at most 1 kgf.

6. The device according to claim 1, wherein the extraction mechanism includes a suction portion configured to suck the sheet or sheets of the stack by a vacuum suction force to extract the sheet or sheets.

7. The device according to claim 5, wherein the extraction mechanism has a suction portion which sucks the sheets, the vibrator has a leading end which is placed closer to the sheet surface of the stack than the suction portion, and the vibrator and the extraction mechanism are arranged so that a difference of 0.1 to 5 mm is set between the leading end and the suction portion.

8. The device according to claim 6, wherein the suction portion sequentially comes into contact with the sheet surface of the stack to extract the sheet, and the leading end of the vibrator comes into contact with the sheet surface of the stack before the suction portion is operated.

9. The device according to claim 1, wherein the vibrator is inclined in a direction in which the sheet is extracted.

10. A method of separating a sheet from a stack of sheets to extraction the sheet from the stack, comprising:

supporting a stack of sheets;

applying a spot vibration on a sheet surface of the stack from a vibrator which includes a vibrating member generating a high frequency vibration having a frequency which is not smaller than 10 kHz and an ultrasonic horn coupled to the vibrating member and amplifying the high frequency vibration, the ultrasonic horn having a leading end which is in spot-contact with a uppermost sheet of the stack to apply the high frequency vibration on the sheet surface of the stack from the ultrasonic horn to separate the sheets of the stack;

extracting a sheet or sheets from the sheet surface of the stack and conveying the sheet or sheets sequentially; and separating one of the sheet or sheets from the other sheet or sheets and convey the one of the sheet, wherein the step of extracting includes sucking the sheet or sheets of the stack by a vacuum suction force to extract the sheet or sheets.

11. The method according to claim 10, wherein the sheet extracting includes feeding the sheet by a frictional force.

12. The method according to claim 10, wherein the step of applying the spot vibrating includes applying a predetermined contact force to the surface of the sheets and vibrating the sheets in a direction substantially orthogonal to the surface of the sheets.

13. The method according to claim 10, wherein the vibration has a vibration frequency of at least 10 KHz.

14. The method according to claim 10, wherein the vibration is applied to the sheets under a contact force of at least 200 gf and at most 1 kgf.

15. The method to claim 10, wherein the vibration is applied to the stack in a direction inclined to the sheet surface.

* * * * *